US005139354A

United States Patent [19]

Saeki

[11] Patent Number: 5,139,354

[45] Date of Patent: Aug. 18, 1992

[54] PRINTER

[75] Inventor: Toshiro Saeki, Tokyo, Japan

[73] Assignee: Seikosha Co., Ltd., Tokyo, Japan

[21] Appl. No.: 751,026

[22] Filed: Aug. 28, 1991

[30] Foreign Application Priority Data

Sep. 3, 1990 [JP] Japan ..... 2-92583[U]

[51] Int. Cl.[5] ..... B41J 11/50

[52] U.S. Cl. ..... 400/605; 400/647.1; 400/625; 400/599.1; 400/693; 400/691

[58] Field of Search ..... 400/690, 690.4, 691, 400/693, 694, 605, 607, 607.2, 647, 647.1, 624, 625, 595, 599.1, 692

[56] References Cited

U.S. PATENT DOCUMENTS 4,526,489 7/1985 Tsumuraya et al. ..... 400/693
4,761,663 8/1988 Piatt et al. ..... 400/693 X
4,909,497 3/1990 Itabashi et al. ..... 400/605 X
5,033,892 7/1991 Fujii et al. ..... 400/692

FOREIGN PATENT DOCUMENTS 0078875 5/1984 Japan ..... 400/605
0158274 9/1984 Japan ..... 400/647.1
0063466 4/1986 Japan ..... 400/691
0174174 7/1987 Japan ..... 400/693
0299368 12/1987 Japan ..... 400/605

*Primary Examiner*—Edgar S. Burr
*Assistant Examiner*—Christopher A. Bennett
*Attorney, Agent, or Firm*—Jordan and Hamburg

[57] ABSTRACT

A printer suitable for use with either a continuous printing form or a separate printing form, includes a printer casing having projections on both sides thereof and a rearwardly inclined groove located below the projections. The paper shelf has elongated grooves formed at both sides of the front portion thereof so as to engage the projections of the printer casing, respectively. When a separate printing form is used, the rear end of the paper shelf is raised by pivoting the paper shelf about the projections of the printer casing and the front edge thereof enters the inclined groove of the printer casing so that when the rear ends of the elongated grooves engage the projections, the paper shelf is positioned by the inclined groove and the projections of the printer casing.

15 Claims, 6 Drawing Sheets 1
1a
1b
1f
1h
2
2a
2c
4
4a
4b
4c'
11b
40
42
42a
42b
42c

PRINTER

FIELD OF THE INVENTION

The present invention relates to a printer.

BACKGROUND OF THE INVENTION

In a printer heretofore used, when used with a continuous paper sheet, the paper sheet proceeds from a casing at a rear side into the casing main body and is printed when fed to a platen. The printed continuous paper sheet is guided by a pinch roller upwardly and is moved onto a paper shelf provided on the printer casing to be free for use or removed.

Also, in the case of the use of cut paper, the paper shelf is obliquely set at the rear portion of the printer, and at the time of paper supply, it is used as a paper guide at the time of exiting of the paper.

In such a printer as described above, in the case of the use of a separate sheet of paper, in order to set the paper shelf obliquely to the printer, a special member therefor is provided, or the printer position is changed to a position different to that when using a continuous sheet of paper, or the paper is set to be reversed in the forward and rear positions. Such procedure is complicated.

Accordingly, an object of the present invention resides in making the supply and exiting of the separate sheet of paper possible with a simple procedure without requiring special parts.

DESCRIPTION OF THE PREFERRED EMBODIMENTS

Figure 1:
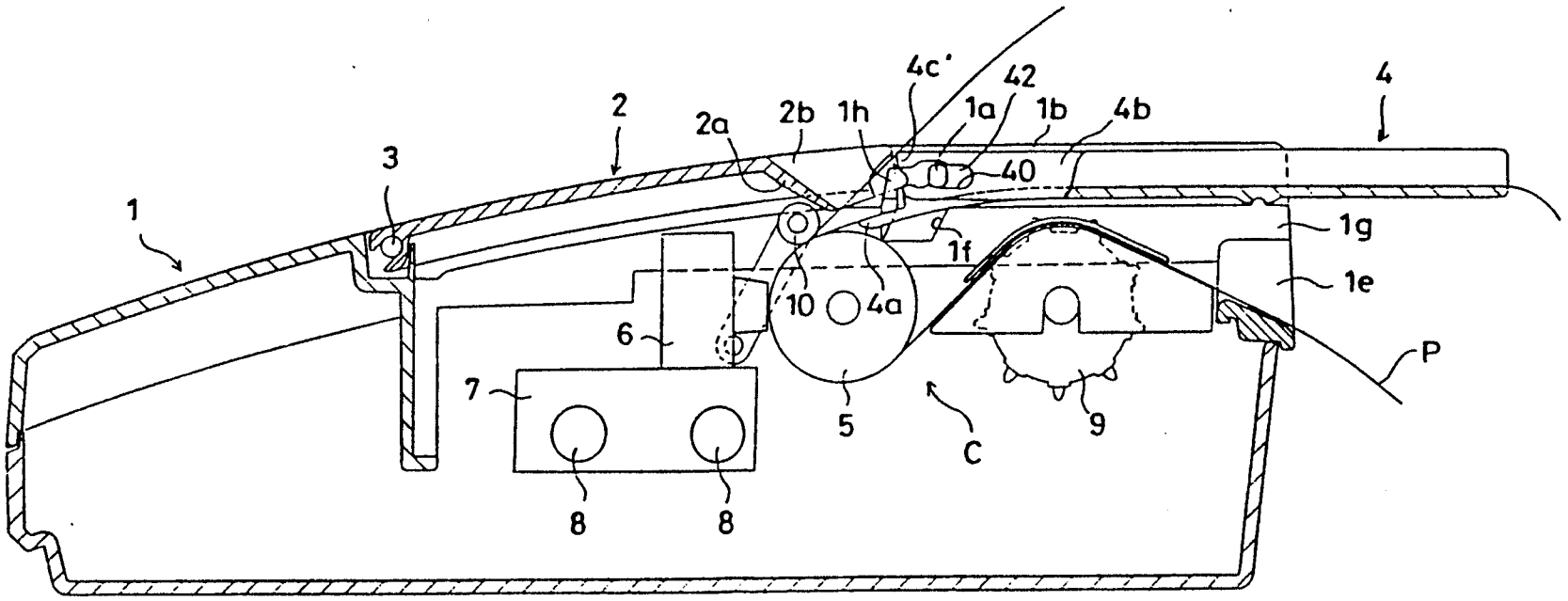
FIG. 1 is a sectional view of a printer according to one embodiment of the invention in which the paper shelf is shown in its lowered position.
Figure 3:
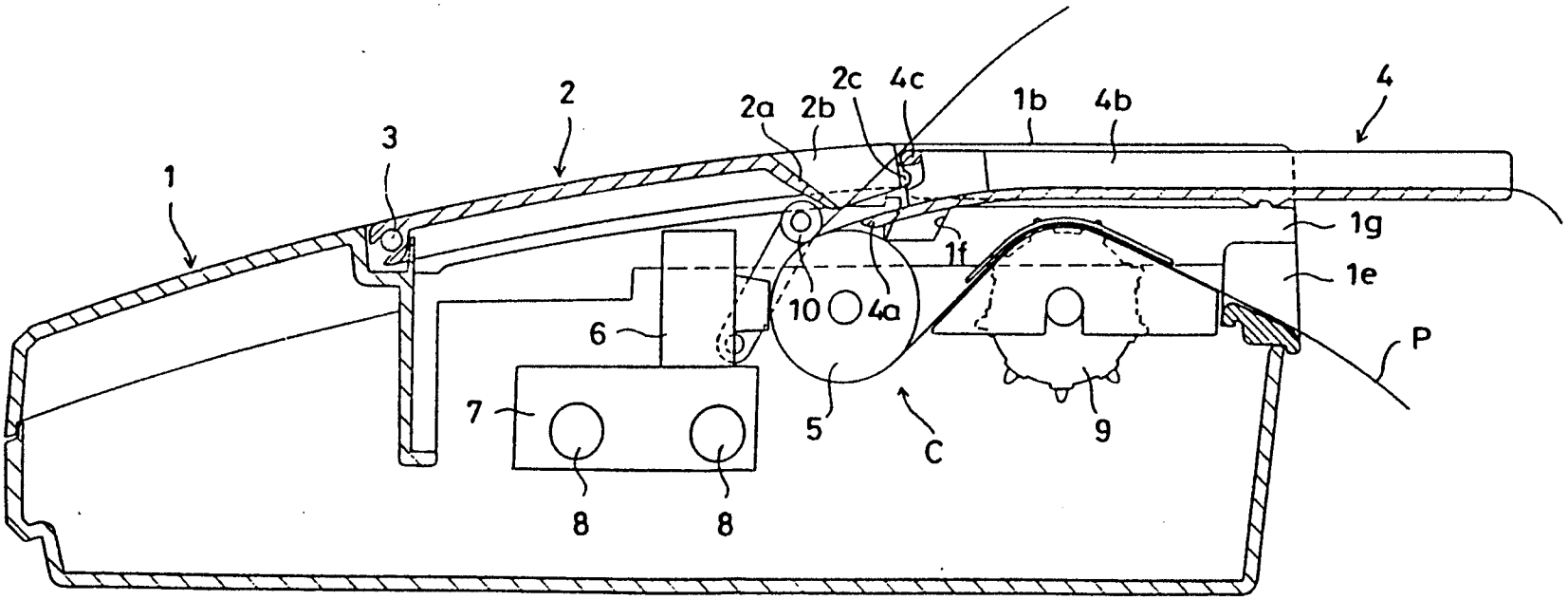
FIG. 3 is another sectional view of the printer with the paper shelf shown in its lowered position.
Figure 4:
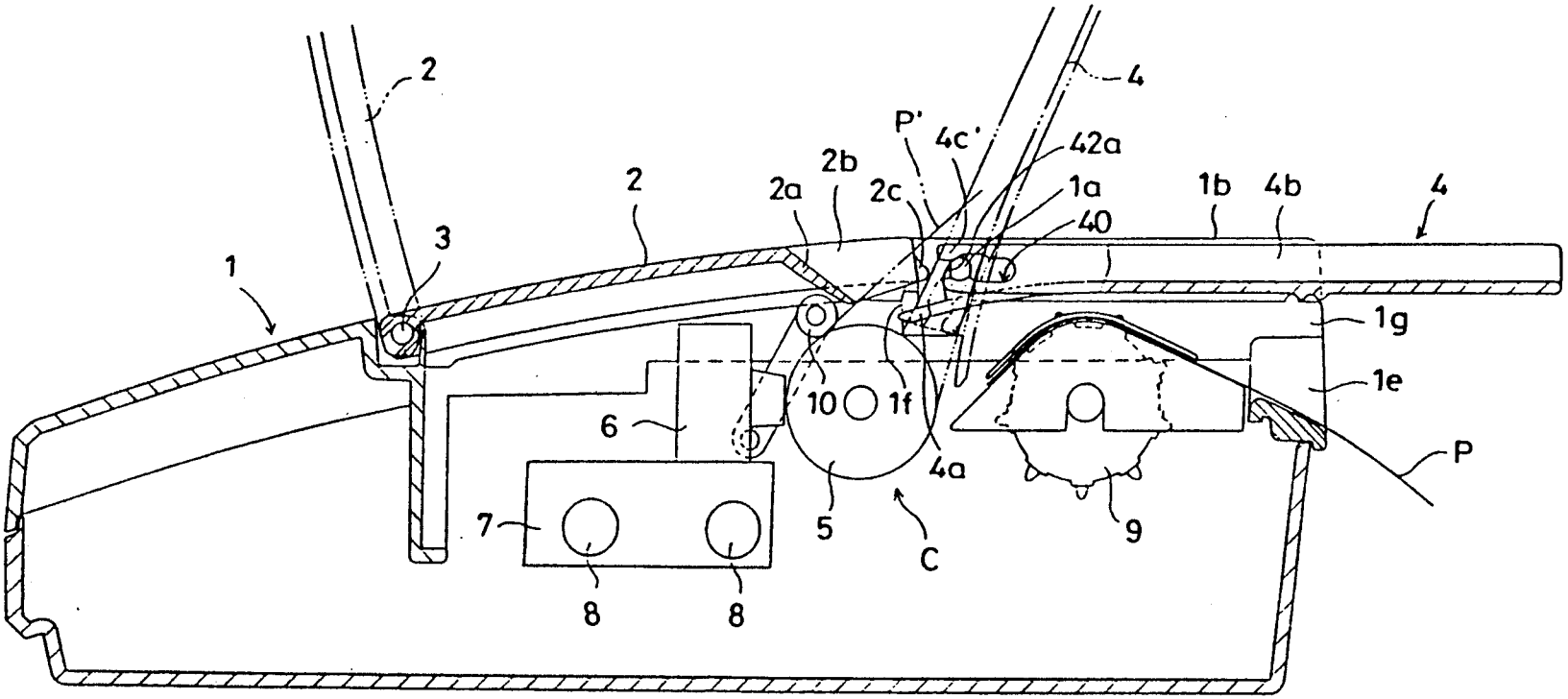
FIG. 4 is a sectional view of the printer showing the raised position of the paper shelf.

In the following, an explanation will be given of an embodiment of the present invention by referring to the drawings. As shown in FIG. 1, at the upper portion of the forward side (the left side in FIG. 1) of a printer casing 1, there is attached a cover 2 which is freely pivotable about a pivot 3. The terminal end portion of the cover 2 bends slightly to the lower side, and at the forward terminal end thereof, a cutter portion 2*a* of a knife-like shape is formed with a predetermined width. At both sides of the cutter portion, there are formed side plates 2*b*, and these side plates are elongated slightly rearwardly from the cutter portion 2*a*, and as shown in FIGS. 3 and 4, at the inside of the rear portion thereof, engaging portions 2*c* are formed to be opposing to each other.

As shown in FIG. 1, on the casing 1 at the rear side of the cover 2, there is mounted a paper shelf 4 free to advance and retract in a range limited in the rear and forward directions.

At the forward terminal portion of the paper shelf 4, there is formed a guide portion 4*a* for the exiting paper arranged in such a manner that the portion 4*a* corresponds to the width of the above-described cutter portion 2*a* and is inclined toward the external circumferencial surface of the platen 5. On both sides of the paper shelf 4 are formed side plates 4*b*.

On the internal surface of the side plate 1*b* of the casing 1, there is formed a protrusion 1*a* for restricting the advance and retraction of the paper shelf 4, and a guide member 1*h* is provided for the paper shelf 4 when the paper shelf is in a position inclined to the printer as will be further described.

At the forward portion of the external surface of the side plate 4*b* of the paper shelf 4 there is formed a long groove 40, and the protrusion 1*a* is received in the long groove 40.

As shown in FIG. 3, inside the forward terminal portion of the side plate 4*b*, there is formed a retaining portion 4*c* which contacts the engaging portion 2*c* to prevent opening of the cover 2.

In the inside of the casing 1, as shown in FIG. 1, there is provided a printing mechanism C. The printing mechanism includes a printing head 6 mounted on a carriage 7 in a position to oppose the platen 5, and is free to be displaced while being guided by a guide shaft 8. Continuous paper P is inserted from a paper supply opening 1*e* at the rear portion of the casing 1 and exits on the paper shelf 4 by passing through the space between the cutter portion 2*a* and the guide portion 4*a* upon being fed to the platen 5 by the sprocket 9. Numeral 10 denotes a pinch roller contacting the platen 5.

On the upper portion of the internal side surface 1*g* of the printer casing 1, there is formed a groove 1*f* in which the side plate 4*b* of the paper shelf 4 is receivable.

Figure 2:
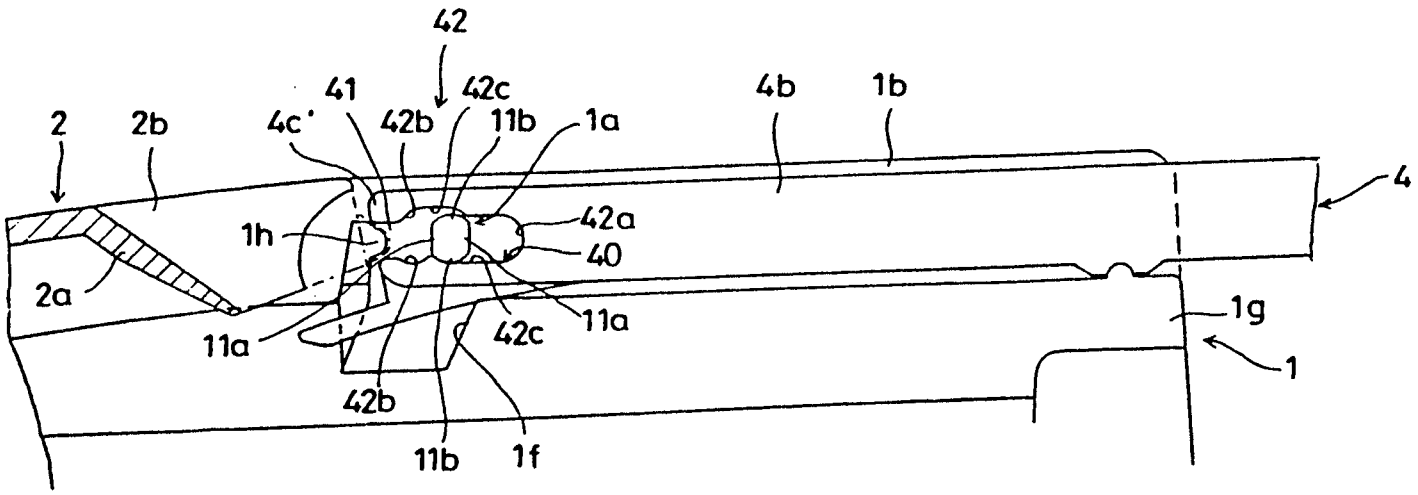
FIG. 2 is a partial side view, partly in section, of the printer shown in FIG. 1 but on a larger scale.

As shown in FIG. 2, the projection 1*a* has a non-circular shape with a large diameter portion 11*b* and a short diameter portion 11*a*.

The long groove 40 comprises an open portion (forward portion) 41 and a rear portion 42, and the rear portion 42 comprises a rear terminal end 42*a* for receiving and stopping the projection 1*a* in the casing when the paper shelf is received in the groove 1*f* of the paper shelf 4. The long groove 40 also comprises first and second stopping portions 42*b* and 42*c* which correspond to the larger diameter portion 11*b* of the projection 1*a*. The forward portion 41 communicates with the first stopping portion 42*b*, and has a width corresponding to the shorter diameter portions 11*a* of the projection 1*a*. The depth of the long groove 40 is such that the rear terminal end thereof 42*a* contacts projection 1*a* when the forward terminal end portion 4*a* of the paper shelf 4 is received in the groove 1*f*.

Figure 5:
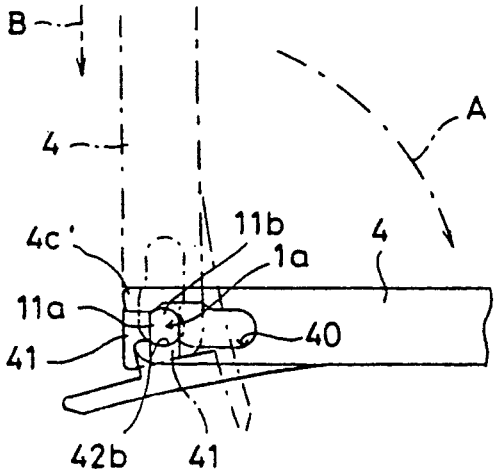
FIG. 5 is an enlarged partial side view of the printer.

An explanation will be given of the method of arranging the casing 1 and the paper shelf 4. As shown in FIG. 5, the paper shelf 4 is lowered in the direction of the arrow B from the upper portion of the printer by directing the open portion 41 downwardly, and the open portion 41 is fitted onto the short diameter portion 11*a*. After the open portion has passed through the short diameter portion 11*a*, when the paper shelf 4 is pivoted in a clockwise direction (in the direction of arrow A), as shown in FIG. 4, the down surface of the paper shelf 4 contacts the internal side surface 1*g* of the casing 1. At this time, as shown in FIG. 5, the long diameter portions 11*b* of the projection 1*a* opposes the first stopping portions 42*b* of the long groove 40. At this time, even if the paper shelf is pulled to the right side, the open portion 41 of the paper shelf 4 can not pass through the long diameter portions 11b of the projection 1a, and the paper shelf 4 is prevented form being removed from the casing main body 1, and due to the above-described procedure, the arrangement of the paper shelf 4 into the casing 1 is completed. In the case when the cover 2 is to be opened in order to exchange the ink ribbon, printing paper, etc., as shown in FIG. 4, the cover 2 is opened by being pivoted in a counterclockwise direction about the pivot 3.

An explanation will now be given of the case where a continuous paper is cut by the cover 2 when using a continuous paper in the printer.

As shown in FIGS. 2 and 3, when the paper shelf 4 is pushed to the left direction, the protrusion 1a passes the first stopping portion 42b, and the second stopping portion 42c then opposes the long diameter portion 11b of the protrusion 1a. At this time, at the inside and outside of the forward terminal end of the side plate 4b of the paper shelf 4, the upper surface of the attaching portion 2c of the cover 2 and the guide member 1h of the casing 1 contact the retaining portion 4c of the paper shelf 4 and the external side of the forward terminal portion 4c' of the side plate 4b, and the paper shelf is unable to be displaced further to the left.

As shown in FIG. 3, by such advancement of the paper shelf 4, the width of the paper outlet port between the cutter portion 2a and the guide portion 4a of the paper shelf is extremely small, and the leakage of noise to the outside of the printer during printing will be reduced, and the noise of the printer will be minimized.

Continuous paper P is inserted through the paper supply port 1e and is printed at the forward part of the platen 5. The printed paper then passes from the paper outlet port between the cutter portion 2a and the guide portion 4a on the paper shelf 4. In the case of cutting the paper P, the cutting occurs at the blade edge of the cutter portion 2a, as the paper is pulled forward. At this time, the engaging portion 2c of the cover 2 is pressed at the upper portion by the retaining portion 4c of the paper shelf 4, and since the force for pulling the paper P provides a turning moment of force in a direction for pushing the lower surface of the paper shelf 4 to the inside surface 1g of the casing 1 around the projection 1a, both the paper shelf 4 and the cover 2 are fixed and unable to move upwardly from the casing 1. Therefore, the paper P can be easily cut off at the cutting position by the cutter portion 2a.

An explanation will now be set forth of the case of using a separate sheet of paper.

Figures 6A, 6B, 6C, 6D, 6E:
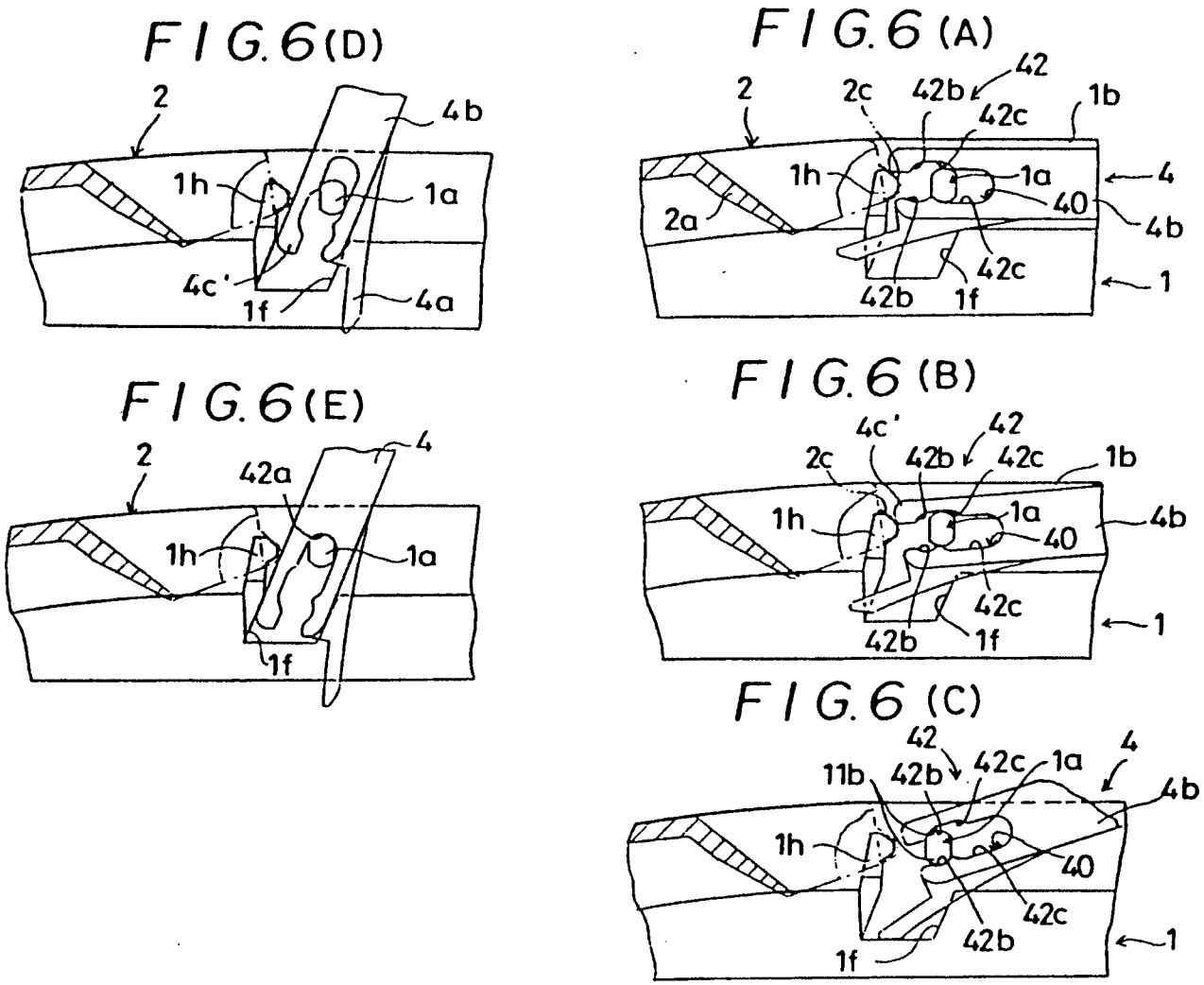
FIGS. 6(A) to 6(E) are enlarged side views showing different operating positions.

As shown in FIG. 6(A), initially the cover 2 is held in a closed position by the paper shelf 4. The rear portion of the paper shelf 4 is then taken, and as shown in FIG. 6(B), when the paper shelf 4 is pivoted in the counterclockwise direction while pulling the paper shelf rearwardly, the forward terminal portion 4c' of the side plate 4b and the retaining portion 4c (not shown in FIG. 6(B)) of the paper shelf 4 are respectively guided by the guide member 1h of the casing 1 and the engaging portion 2c of the cover 2, and displaced rearwardly. As shown in FIG. 6(C), the stopping portions 42b of the paper shelf 4 reaches a position to oppose the long diameter portion 11b of the protrusion 1a, and the paper shelf 4 rotates in a counterclockwise direction with the protrusion 1a as the center, and when it has rotated for about 90 degrees, by pushing the paper shelf 4 downwardly as shown in FIG. 6(D), the forward terminal portion 4c' of the side plate 4b of the paper shelf 4 will be received in the groove 1f, and as shown in FIG. 6(E), while the paper shelf 4 is in a guiding position, and is retained in this position, the rear terminal portion 42a of the paper shelf 4 contacts the protrusion 1a, and thereby, the position of the paper shelf 4 is determined and preserved by the groove 1f and the protrusion 1a.

At this time, as shown by the broken lines in FIG. 4, the paper shelf 4 is set obliquely to the printer.

Since printing is not being carried out on the continuous paper P, the continuous paper P is disposed in a waiting position at the tractor 9.

One sheet of a separate paper P' is set on the paper shelf 4. At this time, the paper shelf 4 is set in such a manner that the circumferencial surface of the platen 5 is disposed in alignment with the guide portion 4a of the paper shelf 4.

Therefore, the separate paper P' passes about the circumference of the platen 5, and is printed in the same manner as in the case of the continuous paper, and then is discharged onto the paper shelf 4.

The shape of the protrusion is not limited to the illustrated embodiment, and may be non-circular with a sectional shape having a long diameter portion and a short diameter portion. Also the shape of the long groove 40 is not limited to the illustrated embodiment, and may have a dimension corresponding to the long diameter portion and the short diameter portion of the protrusion. Also, the long groove 40 may be provided so as not to be one body, and may be provided on the side plate 4b of the paper shelf 4 in one body, or may be provided on the paper shelf 4 in another shape. Also, various kinds of printing methods of the printer may be used other than the wire dot type such as the non-impact type, etc.

According to the present invention, the long groove in the forward part of both side portions of the paper shelf is fitted to the protrusion of both side portions of the printer casing to make it possible to rotate and to advance and retract. A casing groove is provided in the casing under the protrusion of such a depth that when the rear end of the long groove contacts the protrusion, the forward terminal portion of the paper shelf is fitted in the casing groove.

Therefore, in the case when a separate sheet of paper is used in the printer, when the paper shelf is lifted up, the paper shelf rotates around the protrusion, and the forward terminal portion of the paper shelf enters the casing groove under the protrusion, and when the rear end of the long groove contacts the protrusion, the position of the paper shelf is determined and preserved by the groove and the protrusion. Thereby, a separate paper can be supplied and discharged from the printer by means of the paper shelf.

Therefore, the supply and discharge of a separate paper sheet can be carried out with a simple procedure without requiring special parts and the production cost can be minimized.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be construed as being included therein.

What I claim is:

1. In a printer, the combination comprising a printer casing, a paper shelf for said printer, mounting means mounting said shelf on said casing for movement between a lowered position and a raised position, said shelf extending longitudinally between a front end portion and a rear end portion, said mounting means comprising projections on said casing and elongated shelf grooves in said front end portion of said shelf receiving said projections, said shelf grooves having an open end portion and a closed end portion, said casing having a casing groove underlying said projections, said open end portion of said shelf groove receiving said projections when said shelf is in said lowered position, said shelf being pivotable and longitudinally slidable relative to said projections when said shelf is moved from said lowered to said raised position such that when said shelf is in said raised position, said projections are disposed in said closed end portion of said shelf grooves and said front end portion of said shelf is disposed in said casing groove.

2. In a printer according to claim 1, wherein said projections engage said closed end portion of said shelf grooves to support said shelf when said shelf is in its raised position.

3. In a printer according to claim 1 further comprising a cover pivotably mounted on said casing for pivotal movement between an open and a closed position, said cover having a cutter section, said cutter section being disposed in a cutting position to cut paper when said cover is in said closed position, said cover having a rear end portion having first engaging means, said front end portion of said shelf having second engaging means, said first and second engaging means being engaged when said shelf is in said lowered position and said cover is in said closed position to retain said cover in its closed position and to retain the cutting section of said cover in said cutting position.

4. In a printer according to claim 1, wherein said casing is provided with guide means juxtaposed to said front end portion of said shelf when said shelf is in said lowered position, said guide means slidably engaging said first end portion of said shelf during initial movement of said shelf from its lowered position toward its raised position such that during said initial movement, said shelf is pivoted and during said pivoting said shelf is shifted longitudinally in a rearward direction by said sliding engagement between said guide means and said front end portion of said shelf.

5. In a printer according to claim 3, wherein said cover has a rear end portion provided with engaging means, said engaging means being juxtaposed to said front end portion of said shelf when said shelf is in said lowered position and said cover is in said closed position, said engaging means slidably engaging said front end portion of said shelf during initial movement of said shelf from its lowered position toward the raised position such that during said initial movement, said shelf is pivoted and during said pivoting said shelf is shifted in a rearward direction by said sliding engagement between said guide means and said front end portion of said shelf.

6. In a printer according to claim 1, wherein said projections have a non-circular cross sectional configuration which includes a large width section and a small width section, said closed end portion of said shelf groove having a width corresponding substantially to the width of said small width section, said open end portion of said shelf groove having a width corresponding substantially to the width of said large width section.

7. In a printer according to claim 1, wherein said printer comprises a platen and a paper feeding means for feeding a continuous sheet of paper to said platen for printing on said continuous sheet of paper.

8. In a printer according to claim 7, wherein said shelf is in said lowered position when said paper feeding means feeds said continuous sheet of paper, said shelf when in said raised position being operable to feed individual sheets of paper to said platen.

9. In a printer according to claim 7 further comprising a cover having a front end portion and a rear end portion, pivot means pivotably supporting said front end portion of said cover on said casing, said rear end portion being formed with paper cutting means which overlie said platen.

10. In a printer according to claim 9, wherein said cover is pivotable between a closed position and an open position, said cover and said shelf each having engaging means which are engaged when said cover is in said closed position and said shelf is in said lowered position to retain said cover in its closed position.

11. In a printer according to claim 1, wherein said projections have first opposed sides spaced from one another a first distance and second opposed sides spaced from one another a second distance which is less than said first distance.

12. In a printer according to claim 1, wherein said open end portion of said groove has opposed spaced walls, one of said spaced walls having an indentation, the other of said spaced walls having a protruding lip opposite said indentation, said lip having an inner side and an outer side, said projections being disposed on said inner side of said lip when said shelf is in said lowered position, said shelf having a first intermediate position intermediate said lowered and raised position, said projections being disposed between said lip and said indentation when said shelf is in said first intermediate position, said shelf having a second intermediate position between said lowered and raised positions, said projection being disposed on said outer side of said lip when said shelf is in said second intermediate position.

13. In a printer, the combination comprising a printer casing, a paper shelf for said printer, mounting means mounting said shelf on said casing for movement between a lowered position and a raised position, said shelf extending longitudinally between a front end portion and a rear end portion, said mounting means comprising projections on said casing and elongated shelf grooves in said front end portion of said shelf receiving said projections, said shelf grooves having an open end portion and a closed end portion, said open end portion of said shelf groove receiving said projections when said shelf is in said lowered position, said shelf being pivotable and longitudinally slidable relative to said projections when said shelf is moved from said lowered to said raised position such that when said shelf is in said raised position, said projections are disposed in said closed end portion of said shelf grooves.

14. In a printer according to claim 13 further comprising a cover pivotably mounted on said casing for pivotal movement between an open and a closed position, said cover having a cutter section, said cutter section being disposed in a cutting position to cut paper when said cover is in said closed position, said cover having engaging means engaged by said shelf when said shelf is in said lowered position and said cover is in said closed position to retain said cover in its closed position and to retain the cutting section of said cover in said cutting position.

15. In a printer according to claim 13, wherein said printer comprises a platen and a paper feeding means for feeding a continuous sheet of paper to said platen for printing on said continuous sheet of paper, said shelf being in said lowered position when said paper feeding means feeds said continuous sheet of paper, said shelf when in said raised position being operable to feed individual sheets of paper to said platen.

* * * * *